US006474418B2

(12) United States Patent
Miramon

(10) Patent No.: US 6,474,418 B2
(45) Date of Patent: Nov. 5, 2002

(54) WELLBORE FLUID RECOVERY SYSTEM AND METHOD

(75) Inventor: Alain J. Miramon, Houston, TX (US)

(73) Assignee: Frank's International, Inc., Houston, TX (US)

( * ) Notice: Subject to any disclaimer, the term of this patent is extended or adjusted under 35 U.S.C. 154(b) by 7 days.

(21) Appl. No.: 09/732,275

(22) Filed: Dec. 7, 2000

(65) Prior Publication Data

US 2002/0070029 A1 Jun. 13, 2002

(51) Int. Cl.[7] ..... E21B 19/16; E21B 33/08

(52) U.S. Cl. ..... 166/377; 166/81.1; 166/97.1; 175/66; 175/218; 405/52

(58) Field of Search ..... 166/75.13, 75.51, 166/81.1, 85.1, 97.1, 377; 175/66, 84, 207, 213, 218; 137/312, 314; 405/52

(56) References Cited

U.S. PATENT DOCUMENTS 1,668,327 A * 5/1928 Manning ..... 166/312
1,985,157 A * 12/1934 Friedman et al. ..... 175/213 X
2,522,444 A * 9/1950 Grable ..... 166/81.1
3,322,198 A * 5/1967 McHenry ..... 166/81.1
3,800,890 A * 4/1974 Gyongyosi et al. ..... 175/209
4,450,905 A * 5/1984 Crain ..... 166/81.1
5,121,796 A * 6/1992 Wigington, Sr. ..... 166/379
5,211,244 A * 5/1993 Arterbury ..... 166/379
5,295,536 A * 3/1994 Bode ..... 166/241.7
5,419,400 A * 5/1995 Wigington, Sr. ..... 166/379

* cited by examiner

*Primary Examiner*—George Suchfield
(74) *Attorney, Agent, or Firm*—The Matthews Firm

(57) ABSTRACT

A wellbore fluid recovery system and method is disclosed for recovering a column of wellbore fluid within a stand of pipe when breaking out joints of a wellbore tubular string. The system comprises a container that can be mounted to seal around the joint. The container is preferably connected through a first valve to a receiving tank to which a vacuum may be applied. A vacuum tank may preferably be provided to assist in producing the vacuum in the receiving tank and a second valve preferably connects between the receiving tank and the vacuum tank. A third valve may be provided for controlling flow from the receiving tank to a storage tank for wellbore fluid. Prior to breaking the joint, a vacuum is preferably applied to the receiving tank. The first valve may then be opened to remove the fluid from the joint that is captured by the container in response to the vacuum in the receiving tank. Subsequently, the third valve is opened to permit drainage between the receiving tank and the storage tank. The first and third valves may then be closed and the second valve may be opened for producing a vacuum in the receiving tank. A vacuum source may be used to increase the vacuum in the receiving tank further as necessary. The second valve may then be closed and the system is ready to operate as described above to receive fluid from the next joint.

21 Claims, 4 Drawing Sheets

WELLBORE FLUID RECOVERY SYSTEM AND METHOD

BACKGROUND OF THE INVENTION

1. Field of the Invention

The present invention relates generally to drilling and completion fluid recovery and, more specifically, to a system for preventing wellbore fluids from being spilled when the threaded connections between the joints of the wellbore tubulars are disconnected, while being tripped out of the wellbore.

2. Description of the Background

During what is sometimes called a "wet" trip, a release of drilling fluid may occur with each of a large number of drill pipe connections that are broken. As the drill pipe string is being removed from the well, for example to substitute a new drilling bit for a worn drilling bit, the drilling mud that may remain in the string can create considerable problems. Each stand of drill pipe may be approximately ninety feet long in accordance with the drilling rig size. Depending on well conditions, the pipe which is removed may therefore contain up to a ninety-foot column of drilling fluid therein. Although variable based on the size of the drill pipe, the volume of fluid in a ninety-foot column may be in the range of as much as one hundred fifty gallons. When a threaded joint between the stand of drill pipe and the drill string is disconnected, this column of mud is released to flow from the length of the drill pipe. This release of wellbore fluids may typically occur m any times during a "wet"trip.

Drilling and completion fluids which include fluids such as weighted mud, oil-based fluids, water-based muds and the like are often quite expensive and may frequently cost more than one million dollars per well. Loss of such fluids during the numerous pipe trips made per well can therefore be quite costly as the fluids will need to be replaced. Moreover, the loss of such fluids can also create pollution which is highly undesirable. As well, the fluids may create an unusually slippery rig floor and surroundings so as to cause safety problems by increasing the likelihood of accidents to operators working on the rig floor.

The above problems are well known in the oil industry and therefore many efforts have been made in past years to limit spillage. One exemplary prior art system for a drilling mud container apparatus is disclosed in U.S. Pat. No. 5,295,536, issued Mar. 22, 1994, to Robert E. Bode, and is incorporated herein by reference. The drilling mud container apparatus provides a container for preventing spilling of drilling mud onto the rig floor to thereby save the mud for later reuse. The invention includes a diametrically split and hinged barrel having a fixed lower seal assembly and a movable upper seal assembly which engage the outer wall of the drill pipe respectively below and above a joint connection that is to be unthreaded. Upon disconnection of the joint and upward movement of the drill pipe, the upper seal moves upward with the pipe to eliminate wear which otherwise would result in seal and mud leakage. The container includes a large drain port and is adapted to be connected to a suitable hose which leads to a mud pit or tank.

However, several significant problems still exist with prior art fluid recovery systems. One problem relates to the amount of time required for the recovery system to operate. Draining large amounts of fluid as each connection is broken considerably increases the overall effective time required to break each connection and therefore significantly increases the time required for tripping the drilling string out of the wellbore. Therefore, the associated time costs of wet trips may also significantly increase the cost of drilling the well. As another factor, unless considerable time is allowed for drainage and dripping, depending on the viscosities and flow rates of the fluid, size and length of pipes, drilling fluid losses may still occur that are greater than permissible under governmental regulations even though the losses are greatly reduced. Another problem is related to the size of the container that must be secured around the pipe joint. To avoid the need for numerous different size containers related to the expected volume of fluid and size of pipe, a single container size with removable seals designed for each pipe size is generally constructed to be large enough in volume to handle the largest flows anticipated. However, due to this large size, the container can be awkward to work with thereby resulting in more loss of time as well as the inconvenience and hazards of working with unwieldy and bulky equipment.

Consequently, it would be desirable to further improve prior art drilling and completion fluid recovery prior art systems. It would be highly desirable to reduce loss of drilling fluid even more than has been possible in the past, and to do so in much less time. It would also be desirable to reduce the size of the container used in prior art systems while still retaining the ability to handle the maximum possible fluid flow as the pipe connection is broken. Thus, it would be desirable to save the considerable cost due to time loss while even further reducing any loss of expensive and possibly environmentally harmful drilling fluids. It is always desirable to further improve safety conditions. Those skilled in the art have therefore long sought and will greatly appreciate the present invention which addresses these and other problems.

SUMMARY OF THE INVENTION

The present invention was designed to provide more efficient operation to thereby save time and reduce drilling costs, significantly improve speed of breaking pipe joints during a wet trip, permit increased automation to reduce required manpower, improve safety, and to reduce any possible well fluid loss into the environment.

Therefore, it is an object of the present invention to provide an improved wellbore fluid recovery system.

Another object of the present invention is to have the ability to reduce the time required for breaking joints during a wet trip.

Yet another object of the present invention is to reduce the size of the container positioned around the pipe joint to catch fluid when the joint is broken.

An advantage of the present invention is improved rig safety.

Another advantage of the present invention is faster operation.

Yet another advantage is lower costs.

These and other objects, features, and advantages of the present invention will become apparent from the drawings, the descriptions given herein, and the appended claims.

Therefore, the present invention provides for a wellbore fluid recovery system for recovering wellbore fluid when breaking one or more joints of wellbore tubulars comprising elements such as a container mountable around each of the one or more joints of the wellbore tubulars, a receiving tank, a first conduit between the container and the receiving tank, and a vacuum source operable for producing a vacuum within the receiving tank.

A first valve may preferably be provided for controlling flow through the first conduit. A vacuum tank is included in a preferred embodiment of the invention and the vacuum source may be adapted for producing a vacuum in the vacuum tank. A second conduit between the vacuum tank and the receiving tank is preferably provided with a second valve for controlling flow through the second conduit. A wellbore fluid storage tank, such as a trip tank, is connected to the receiving tank by a third conduit. A third valve controls flow through the third conduit.

In one preferred embodiment, the container for attachment around the pipe joint has a container volume less than a volume of the column of wellbore fluid to thereby provide a more compact container.

The method of the invention may preferably comprise steps such as the steps of placing the container around the joint, unscrewing the joint, applying the vacuum to the container, and collecting the fluid in the receiving tank. The step of applying the vacuum may further comprise opening the first valve to permit fluid communication between the receiving tank and the container. Prior to opening the first valve, the vacuum is preferably produced in the receiving tank. In a preferred embodiment, the vacuum is first produced in the vacuum tank and then the second valve between the vacuum tank and the receiving tank is opened. Prior to operation, all three valves are closed. After fluid is collected in the receiving tank, the third valve is opened to drain the wellbore fluid into a storage tank.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE PREFERRED EMBODIMENTS

Figure 1:
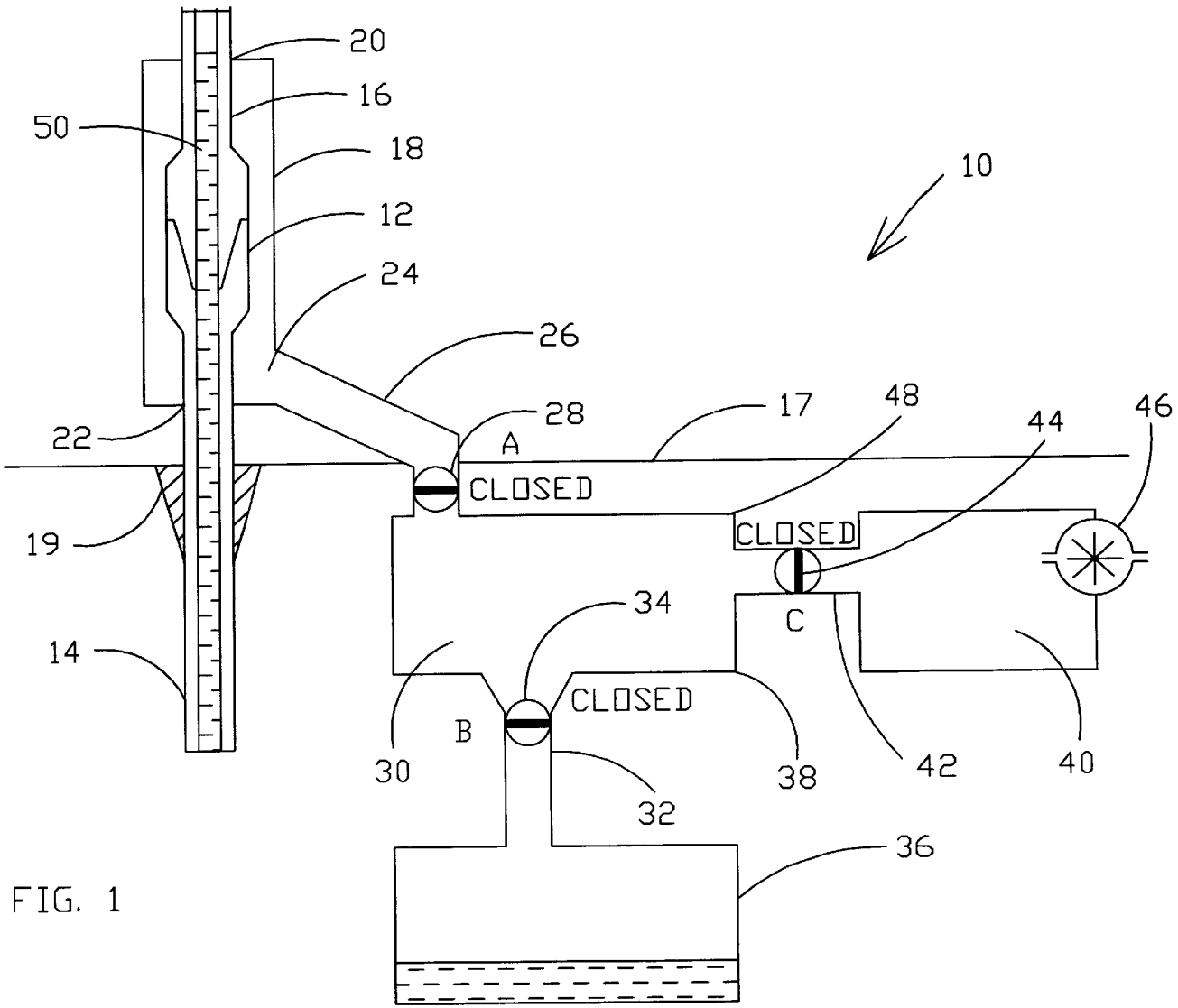
FIG. 1 is a schematic view of a system in accord with an embodiment of the present invention prior to breaking of the wellbore tubular joint.

Referring now to the drawings which show operation of fluid recovery system 10 in accord with the present invention, and more particularly to FIG. 1, there is shown drilling recovery system 10 prepared for receiving wellbore fluids such as drilling or completion fluids as wellbore tubular threaded connection 12 is broken apart in a manner known by those skilled in the art. Thus, wellbore pipe string 14, such as a drill pipe string, completion string, production string, or other wellbore tubular string, is being pulled from the wellbore through rig floor 17. Upper stand of pipe 16 may typically include about three drill pipes threadably connected together. Each drill pipe is typically about thirty feet long. The drilling rig height normally allows multiple pipes to be contained in each stand so that, for instance, only every third pipe connection needs to be disconnected. Each stand is lifted, set aside, and stacked upright on one side of the derrick until drill pipe string 14 is to be run back into the well. By working with stands of multiple pipes rather than individual pipes, a great deal of time is saved.

Depending on the hydraulics of the wellbore, it may be that the annular pressure outside the drill string 14 is greater than the pressure within the drill string. This may occur, for instance, due to heavy cuttings in the wellbore fluid, U-tube effects, and the like. When pulling out the drill string with a bit having small or clogged jets, nozzles, or water ways, the mud may be trapped in the drill string or not have time to drain during the trip out of the hole. Thus, it is well known that when connection 12 is broken, approximately ninety feet of mud column inside drill stand 16 may be dumped out of the bottom end of stand 16. Prior to breaking connection 12, slips 19 engage drill string 14 to prevent drill string 14 from dropping into the wellbore when connection 12 is released. The connection may then be initially slightly rotated a few degrees by applying a high initial breaking torque with powered tongs of which there are many types. Prior to spinning stand 16 with respect to wellbore string 14 to thereby completely unscrew connection 12, and perhaps prior to initial breaking of the connection with power tongs as discussed above, fluid recovery container 18 is preferably placed around connection 12 in a manner known to those of skill in the art. Fluid recovery container 18 will preferably include upper and lower seals such as upper seal 20 above joint 12 and lower seal 22 below joint 12. The seals may be of various types such as sliding seals and the like as are known in the prior art.

It will be understood that such terms as "up," "down," "vertical" and the like are made with reference to the drawings and/or the earth and that the devices may not be arranged in such positions at all times depending on variations in operation, transportation, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size of the components may be greatly different from that shown, e.g., a wellbore fluid storage tank such as trip tank 36, discussed below, may typically be much larger than receiving tank 30.

Outlet 24 is provided from container 18, and is connected by hose or pipe 26, through valve 28 to recovery tank 30. Valve 28 may be of many types including but not limited to rotatable element valves such as ball valves, plug valves, butterfly valves, and the like, sliding element valves such as gate valves and the like, pivotal element valves such as flapper valves, plunger and seat valves, and any other suitable valves. Thus, valve 28 may be any type of valve so long as it is suitable to provide the function of the system as discussed hereinafter. Valve 28 may be manual or automatic, hydraulically operated, air operated, biased to one position as desired, or have other controls and the like. Again, any variety or combination of operating features may be used for controlling valve 28 so long as such operational features are suitable to provide the function of the system as discussed herein. As well, valve 28 may comprise more than one valve, more than one valve element, single or multiple valve controllers or actuators and the like, and/or more than one conduit such as conduit 26.

Recovery tank 30 has one or more outlets such as outlet 32 with one or more valves such as valve 34 that leads to rig reservoir tank 36 for storing wellbore fluids such as a trip tank, mud pit or tank, and/or other fluid tank in which it is desirable to store the recovered wellbore fluids. Outlet 32 may preferably be located on or near bottom section 38 of fluid recovery tank 30 so as to facilitate gravity feed or flow of fluid from recovery tank 30 to reservoir tank 36. Valve 34 could also be of many types and could be operated by many methods and controls some but not all of which were mentioned above in connection with valve 28. Valve 34 may or may not be the same type of valve or valves as valve 28.

Recovery tank 30 also connects to vacuum tank 40 through one or more outlets such as outlet 42 through which fluid flow is controlled by one or more valves such as valve 44. Valve 44, like valves 34 and 28 discussed above may be of many different types with many different types of controls. Vacuum tank 40 includes, in a presently preferred embodiment, one or more vacuum pumps such as vacuum pump 46 for producing a vacuum within vacuum tank 40. Outlet 42 may preferably be located near an upper or top section 48 of reservoir tank 30 to reduce the likelihood of liquid flow therethrough.

In the sequence of operation of a preferred embodiment of the invention as illustrated by FIG. 1, valves 28, 34, and 44 are initially closed. A vacuum has been formed in receiving tank 30, as will be discussed subsequently. Because all outlets 26, 32, and 42 are closed by their respective valves 28, 34, and 44, the vacuum is maintained within receiving tank 30. Receiving tank 30 is therefore sufficiently air tight for this purpose. Receiving tank 30 has sufficient volume to receive the entire column 50 of wellbore fluid in stand 16 and so may preferably be greater than one hundred fifty gallons or any suitable size for quick filling thereof.

Figure 2:
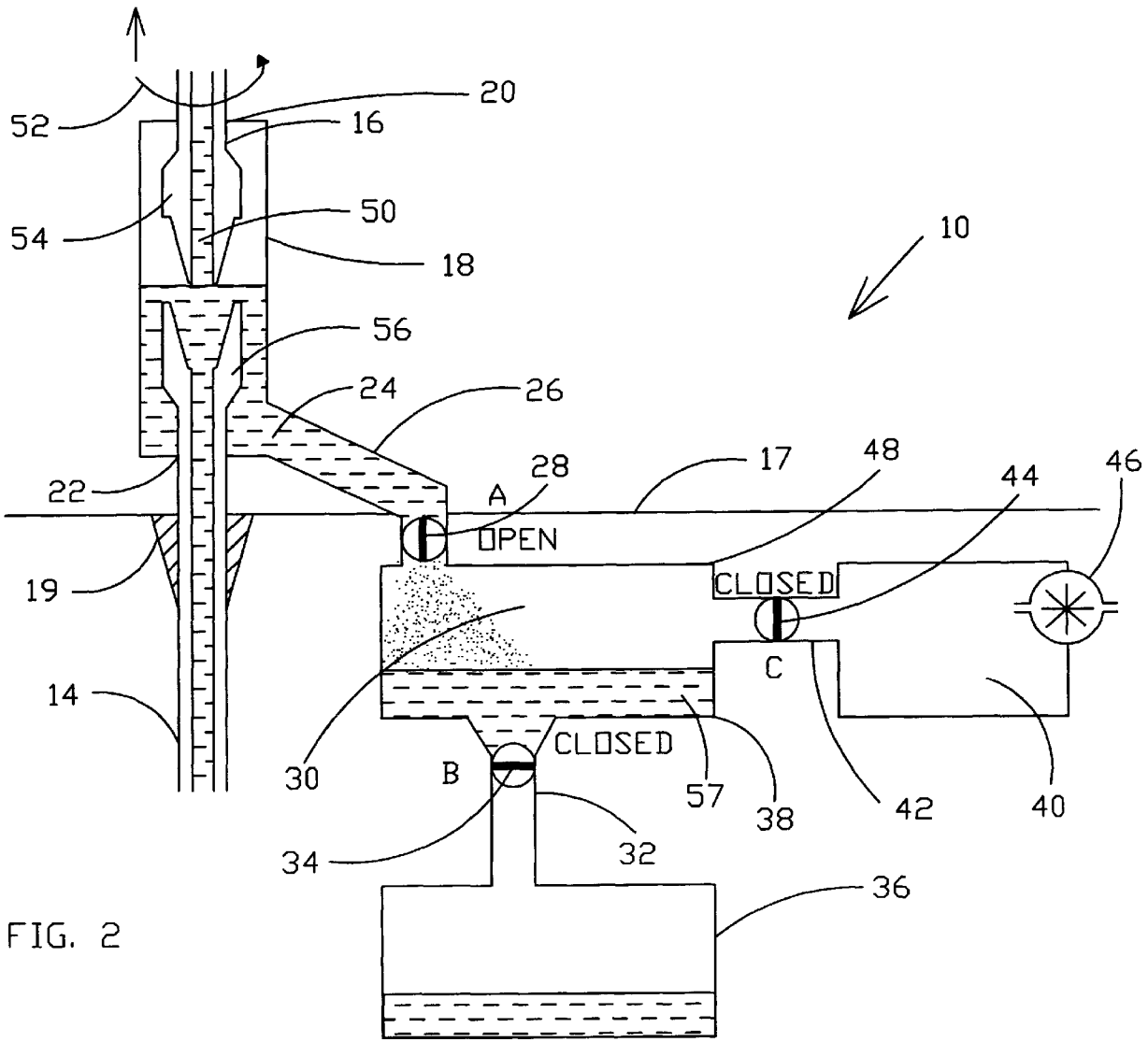
FIG. 2 is a schematic view of the system of FIG. 1, when the wellbore tubular joint is broken and fluid is drawn by vacuum into a receiving tank in accord with an embodiment of the present invention.

In FIG. 2, stand 16 has been rotated such as with a spinner, or other pipe rotating means which may be of many different types typically but perhaps not always in the counterclockwise direction indicated by arrow 52 to thereby unscrew joint 12 to break apart pin 54 from box member 56. Therefore wellbore fluid in column 50 flows out into container 18 which, as stated above, is preferably sealed around pipe or stand 16 with seals such as seal 20 and 22. Use of the present invention reduces the likelihood of leakage of seals 20 and 22 due to the vacuum applied to container 18 as discussed herein. During this time period, or shortly before or after the stand is spun to disconnect joint 12, valve 28 is preferably opened. Valve 34 and preferably valve 44 may remain closed at this time as indicated in FIG. 2. The vacuum within receiving tank 30 creates a suction force on the wellbore fluid in stand 16 due to the differential pressure between the atmospheric pressure and vacuum inside receiving tank 30. This suction force, in addition to the gravitational force, acts on the wellbore fluid in stand 16 to cause the wellbore fluid to flow more quickly into receiving tank 30 where the fluid is accumulated as indicated at 57. The greater the vacuum, the faster fluid will flow. As well, increased hose size of conduit 26 or multiple hoses will enhance fluid flow. Due to the vacuum, the fluid flow will continue to flow from container 18 much faster than if left to flow purely by gravity. As well, less fluid will be left within container 18 and stand 16 in a shorter period of time. Thus, expensive rig time is saved as compared to the prior art. As well, because container 18 will be empty quickly due to opening of valve 28, container 18 can be much smaller and more convenient to work with thereby again saving expensive rig time and also improving rig safety conditions. The smaller interior surface area of container 18 also reduces the amount of possible fluid loss and drainage time. Thus, all or practically all wellbore fluid is drawn by the vacuum in receiving tank 30 until the vacuum is exhausted and the pressure within receiving tank 30 preferably reaches atmospheric pressure.

Figure 3:
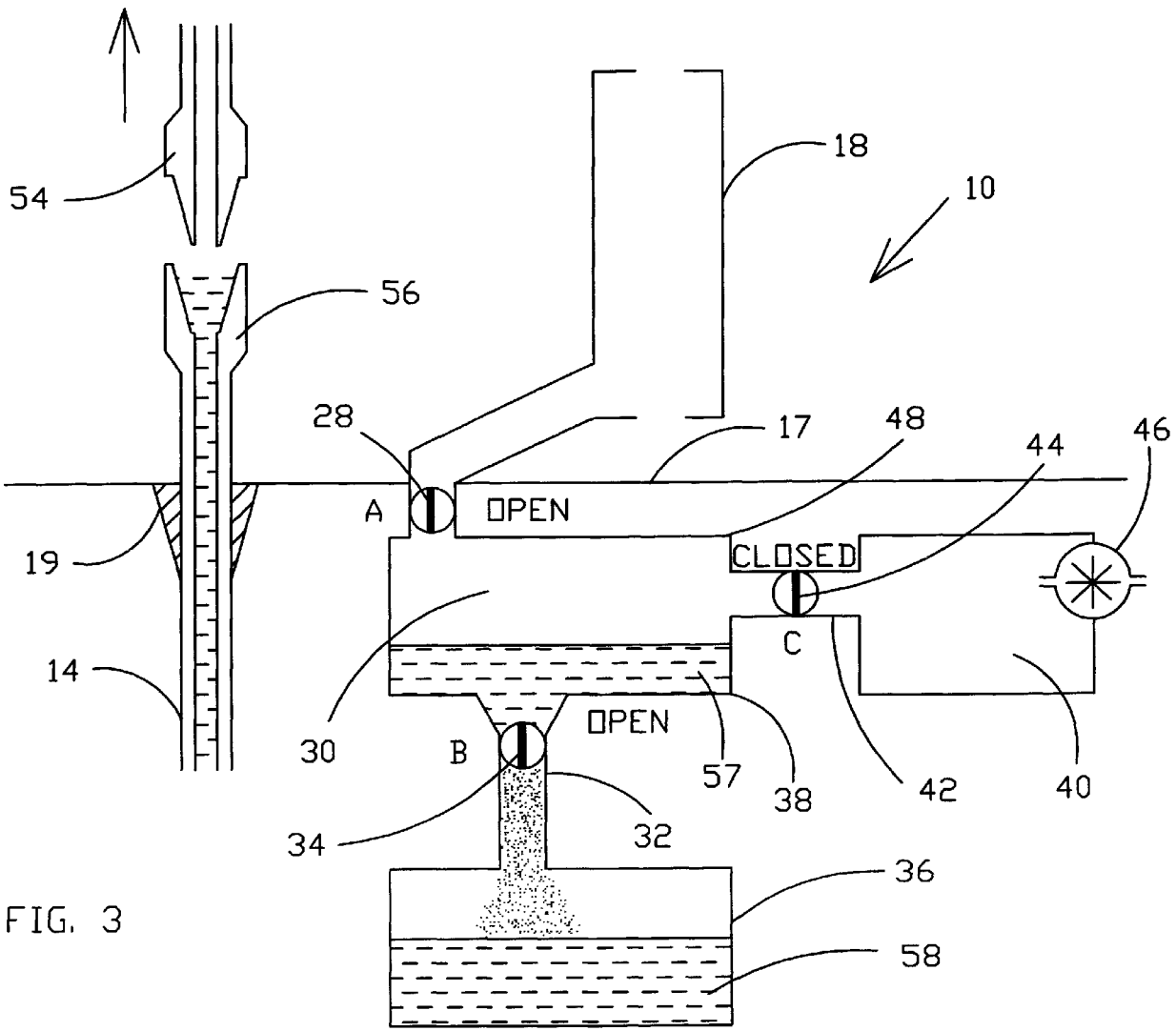
FIG. 3 is a schematic view of the system of FIG. 2, after fluid has been drawn into the receiving tank and flows therefrom by gravity into a rig site well fluid reservoir as the drill pipe is racked in the derrick.

Receiving tank 30 is then drained as indicated in FIG. 3. During drainage of receiving tank 30 by opening of valve 34, valve 44 to vacuum tank 40 preferably remains closed. Due to the present invention, container 18 may be more quickly removed from around pin 54 of stand 16 and box 56 of the remaining wellbore tubular string 16. Thus as also indicated in FIG. 3, container 18 is removed to allow stacking of stand 16. At this time, valve 34 is left open to allow fluid to drain by gravity into any desired tank 36 for the rig fluid system such as a trip tank. As the rig is busy stacking stand 16 and getting ready to pull another stand from wellbore tubular string 14, there is time to permit gravity drainage of system 10 that does not interfere or slow down rig operation as occurs when gravity drainage is used to drain a typically larger container 18. Valve 28 may also preferably be left open during this time to enhance drainage into tank 36 from receiving tank 30.

Figure 4:
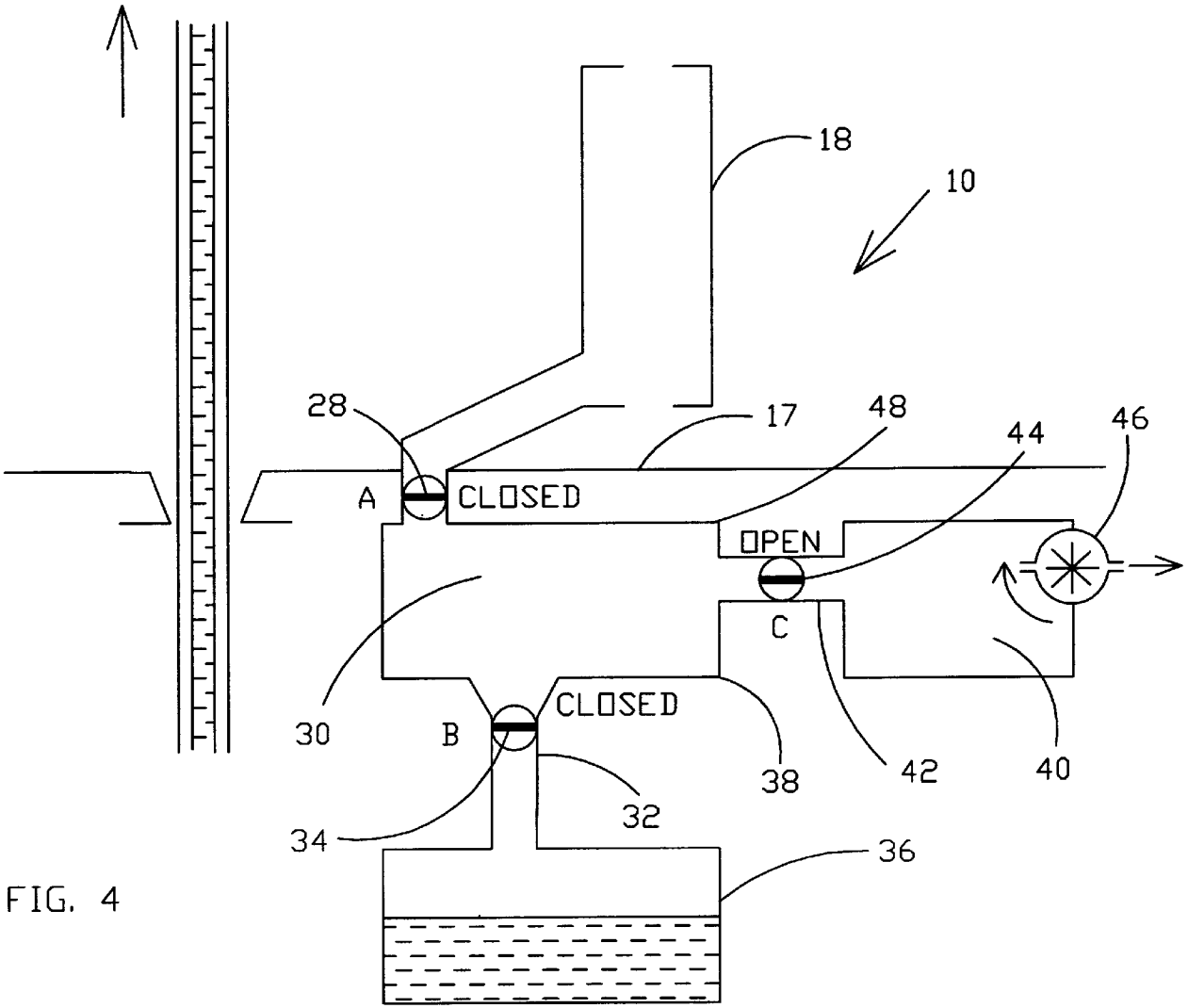
FIG. 4 is a schematic view of the system of FIG. 3, after fluid has flowed out of the receiving tank and a vacuum is again produced in the receiving tank to place thereby the system in the status shown in FIG. 1.

FIG. 4 shows a presently preferred embodiment of the next stage of operation of system 10. Valves 28 and 34 are closed. Valve 44 is opened. Vacuum tank 40 preferably already has a vacuum therein. After review of the present specification, one of skill in the art will understand there are different possible methods of operation and system 10 features to produce the vacuum in receiving tank 30. For instance, depending on the size of vacuum tank 40 as compared to the size of receiving tank 30, and the degree of vacuum in vacuum tank 40, as compared to the desired amount of vacuum in receiving tank 30, system 10 may, if desired, be designed such that the opening of valve 44 almost instantaneously places receiving tank 30 at the desired vacuum. In one embodiment, vacuum pump 46 could even be a smaller less expensive vacuum pump that runs for a longer time such as during the operation shown in FIG. 1, FIG. 2, and FIG. 3, to place vacuum tank 40 at a desired vacuum level. Alternatively, the vacuum in tank 40 may partially evacuate receiving tank 30 with some additional vacuum assist required from vacuum pump 46 which will be sized to produce the desired vacuum in tank 30 within a short time period as will be available without slowing normal rig time operation as the next pipe joint is being positioned by the rig. Vacuum pump 46 may be activated manually or automatically, such as for instance by a switch responsive to a reduced level of vacuum. After activation, depending on the desired arrangement of system 10, vacuum pump 46 may continue to operate until the desired amount of vacuum is produced within receiving tank 30 and/or vacuum tank 40. In yet another embodiment, vacuum pump 46 could be directly connected to tank 30 assuming the action of vacuum pump 46 or multiple vacuum pumps is sufficient to produce the desired amount of vacuum in receiving tank 30 within the time allowed for stacking stand 16 and pulling up a new stand for removal from wellbore tubular string 16 which may typically be in the range of 15–60 seconds. At that time, valve 44 is closed again. Pump 46 may be turned off or, if desired, pump 46 may continue to reduce the pressure in vacuum tank 40 to a level less than that of receiving tank 30. The sequence of replenishing the vacuum, e.g., reduced pressure with respect to atmospheric pressure, within receiving tank 30 may preferably take place as wellbore tubular string 14, such as a drill string or production string or other tubular string, is being lifted by the rig blocks (not shown). When wellbore tubular string 14 is raised to the proper position, then slips 19 will be set, container 18 will be positioned around the next joint to be broken or which is already partially broken, and system 10 will again be in the situation as indicated in FIG. 1. Thus, FIG. 1–4 illustrates a sequence that is repeated for each connection 12 that is broken.

It will be understood from the discussion above that various changes and alternatives may be used that are within the spirit of the invention. For instance, system 10 of the present invention may be combined with automatic pipe breaking assemblies so as to be fully automated. System 10 may also be combined and/or operated in conjunction with other devices such as pipe handling or racking tools. A control system may be used to completely automate operation of valves 28, 34, and 44, vacuum pump 46, container 18, and the like. Alternatively, the system could be manually operated or some parts could be automatic and others manual. Various sensors such as fluid flow sensors, valve state sensors, fluid level indicators, pressure indicators, and the like could be used as part of a control system for fluid recovery system 10. The supporting arm of container 18 could be attached to an automatic pipe breakout unit which unit may have two or more torque arms and/or power spinners. While a separate vacuum tank 40 is preferably used, vacuum pump 46 might also be attached directly to receiving tank 30 and/or other vacuum systems and arrangements may be made to apply a vacuum to container 18 and/or to produce and/or maintain a vacuum within receiving tank 30. A two stage vacuum or multiple stage assist may be used whereby a second vacuum is applied to receiving tank 30 or container 18 either simultaneously or subsequent to that of system 10 as described hereinbefore.

While system 10 is shown as being constructed with most elements located below rig floor 17 where tanks 30 and 40 are conveniently out of the way, fluid recovery system 10 could also contain one or more tanks above the rig floor or positioned as is convenient for rig conditions.

The foregoing disclosure and description of the invention is illustrative and explanatory thereof, and it will be appreciated by those skilled in the art, that various changes in the size, shape and materials, the use of mechanical equivalents, as well as in the details of the illustrated construction or combinations of features of the various elements may be made without departing from the spirit of the invention.

What is claimed is:

1. A wellbore fluid recovery system for recovering wellbore fluid when disconnecting a joint of a wellbore tubular string, comprising:

a container mountable around said joint of said wellbore tubular string;

a receiving tank;

a first conduit between said container and said receiving tank; and a vacuum source operable for producing a vacuum within said receiving tank.

2. The wellbore fluid recovery system of claim 1, further comprising:

a first valve for controlling flow through said first conduit.

3. The wellbore fluid recovery system of claim 1, further comprising:

a vacuum tank, said vacuum source being adapted for producing a vacuum in said vacuum tank, and a vacuum tank conduit between said vacuum tank and said receiving tank.

4. The wellbore fluid recovery system of claim 3, further comprising:

a vacuum tank valve for controlling flow through said vacuum tank conduit.

5. The wellbore fluid recovery system of claim 1, further comprising:

a wellbore fluid storage tank, and a storage tank conduit between s aid recovery tank and said wellbore fluid storage tank.

6. The wellbore fluid recovery system of claim 5, further comprising.

a storage tank valve for controlling flow through said storage tank conduit.

7. A method for recovering wellbore drilling liquids when disconnecting a joint of a wellbore tubular string, said method comprising:

placing a container around said joint;

unscrewing said joint; and applying a vacuum to said container.

8. The method of claim 7, wherein said step of applying said vacuum further comprises:

opening a valve to permit fluid communication between a receiving tank and said container.

9. The method of claim 8, further comprising:

applying said vacuum to said receiving tank.

10. The method of claim 9, further comprising:

producing said vacuum in a vacuum tank and opening a valve between said vacuum tank and said receiving tank.

11. The method of claim 7, further comprising:

opening a valve connected in a fluid path between said container and a storage tank to drain said wellbore liquid into said storage tank.

12. A method for recovering wellbore fluid when disconnecting a joint of a wellbore tubular string, said method comprising:

placing a container around said joint;

producing a vacuum in a receiving tank; and opening a first valve between said container and said receiving tank.

13. The method of claim 12, further comprising:

opening a storage tank valve between said receiving tank and a wellbore fluid storage tank.

14. The method of claim 13, further comprising:

closing said first valve and said storage tank valve.

15. The method of claim 12, wherein said step of producing said vacuum in said receiving tank further comprises:

opening a vacuum tank valve between a vacuum tank and said receiving tank.

16. The method of claim 12, wherein said step of producing said vacuum in said receiving tank further comprises:

operating a vacuum pump.

17. The method of claim 12, further comprising:

closing said first valve, closing a storage tank valve for a wellbore fluid storage tank, said storage tank being selectively in communication with said receiving tank through said storage tank valve, and closing a vacuum tank valve for a vacuum tank prior to unscrewing said joint from which wellbore fluid is to be recovered, said vacuum tank being selectively in communication with said receiving tank through said vacuum tank valve.

18. A wellbore fluid recovery system for recovering a column of wellbore fluid when disconnecting a joint of a wellbore tubular string, comprising:

a container mountable around said wellbore tubular string;

a receiving tank;

a vacuum source for producing a vacuum within said receiving tank; and a first valve mounted between said container and said receiving tank for controlling flow between said container and said receiving tank.

19. The wellbore fluid recovery system of claim 18, further comprising:

a vacuum tank, said vacuum source being mounted to said vacuum tank, and a vacuum tank valve mounted between said vacuum tank and said receiving tank.

20. The wellbore fluid recovery system of claim 18, further comprising:

a wellbore fluid storage tank; and a storage tank valve mounted between said wellbore fluid storage tank and said receiving tank.

21. The wellbore fluid recovery system of claim 18, wherein:

said container has a container volume less than a volume of said column of wellbore fluid.

* * * * *